US009554652B2

(12) United States Patent
Birkbeck

(10) Patent No.: US 9,554,652 B2
(45) Date of Patent: Jan. 31, 2017

(54) LINK CHAIR ACTION

(76) Inventor: Hilary Rolf Birkbeck, Fenny Compton (GB)

( * ) Notice: Subject to any disclaimer, the term of this patent is extended or adjusted under 35 U.S.C. 154(b) by 408 days.

(21) Appl. No.: 13/821,592

(22) PCT Filed: Sep. 12, 2011

(86) PCT No.: PCT/GB2011/051706
§ 371 (c)(1),
(2), (4) Date: Sep. 23, 2013

(87) PCT Pub. No.: WO2012/035329
PCT Pub. Date: Mar. 22, 2012

(65) Prior Publication Data
US 2014/0028068 A1 Jan. 30, 2014

(30) Foreign Application Priority Data
Sep. 15, 2010 (GB) ..... 1015414.4

(51) Int. Cl.
*A47C 1/022* (2006.01)
*A47C 1/032* (2006.01)

(52) U.S. Cl.
CPC ..... *A47C 1/022* (2013.01); *A47C 1/03255* (2013.01); *A47C 1/03272* (2013.01); *A47C 1/03294* (2013.01)

(58) Field of Classification Search
CPC ..... A47C 1/03255; A47C 1/03272; A47C 1/03294; A47C 1/022
USPC ..... 297/463.1, 342
See application file for complete search history.

(56) References Cited

U.S. PATENT DOCUMENTS

| | | | | |
|---|---|---|---|---|
| 4,765,679 | A * | 8/1988 | Lanuzzi et al. | 297/300.3 |
| 4,966,411 | A | 10/1990 | Katagiri et al. | |
| 6,905,171 | B2 | 6/2005 | Knoblock et al. | |
| D536,890 | S | 2/2007 | Loew et al. | |
| 7,188,900 | B1 | 3/2007 | Raftery | |
| 7,611,202 | B2 | 11/2009 | Johnson et al. | |
| 2004/0075321 | A1 | 4/2004 | Sangiorgio | |
| 2004/0155502 | A1 | 8/2004 | Johnson et al. | |

(Continued)

FOREIGN PATENT DOCUMENTS

| | | |
|---|---|---|
| CA | 2 446 654 | 4/2005 |
| CA | 2446654 | 4/2005 |

(Continued)

OTHER PUBLICATIONS

Sara M. Donelson and Claire C. Gordon, Matched Anthropometric Database of U.S. Marine Corps Personnel: Summary Statistics Natic Research, Development and Engineering Centre Technical Report, 1995.

(Continued)

*Primary Examiner* — Milton Nelson, Jr.
(74) *Attorney, Agent, or Firm* — Dikcinson Wright PLLC

(57) ABSTRACT

A (recliner) chair action of relatively movable seat frame (11), (back) drive frame (12) and yoke frame (13), with intervening links (16, 17, 18, 19), independently grouped respectively between seat frame and drive frame and between drive frame and yoke frame; for seat translation and elevation upon back recline operable under a potential energy function in an inter-relationship between back recline and seat movement, for a common or harmonious experience between different occupancy weights.

7 Claims, 12 Drawing Sheets

(56) References Cited

U.S. PATENT DOCUMENTS

| | | | |
|---|---|---|---|
| 2005/0146185 | A1 | 7/2005 | Fookes et al. |
| 2005/0275265 | A1 | 12/2005 | Deimen et al. |
| 2008/0084100 | A1 | 4/2008 | Curiger |
| 2009/0146476 | A1 | 6/2009 | Kan et al. |
| 2009/0152921 | A1 | 6/2009 | Johnson et al. |
| 2011/0193384 | A1 | 8/2011 | Ni |

FOREIGN PATENT DOCUMENTS

| | | | | |
|---|---|---|---|---|
| CA | 2 492 759 | | 7/2006 | |
| CA | 2492759 | | 7/2006 | |
| CN | 201602416 | | 10/2010 | |
| CN | 201630697 | | 11/2010 | |
| EP | 1987739 | | 11/2008 | |
| ES | 2347636 | | 11/2010 | |
| IT | WO 2009153811 | A1 * | 12/2009 | ..... A47C 1/03255 |
| NL | 9002329 | | 5/1992 | |
| WO | WO 9315631 | | 8/1993 | |
| WO | WO 2008020824 | | 2/2008 | |
| WO | WO 2009153811 | | 12/2009 | |
| WO | WO 2010097818 | | 9/2010 | |

OTHER PUBLICATIONS

International Search Report for PCT/GB2011/051706, Jan. 4, 2012.
Tun Yu, "SA-9000" chair adjustment mechanism technical sheet. Publication date unknown.
L&P Office Components International, "LP02" chair adjustment mechanism technical sheet. Publication date unknown.

* cited by examiner

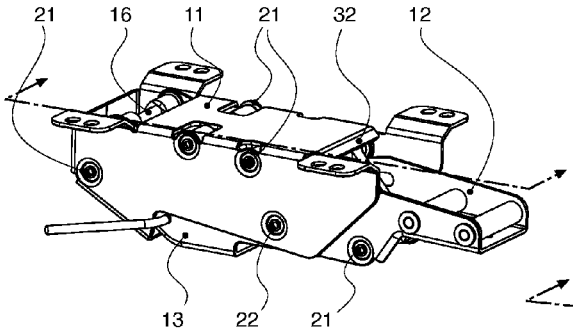
Figure 1A
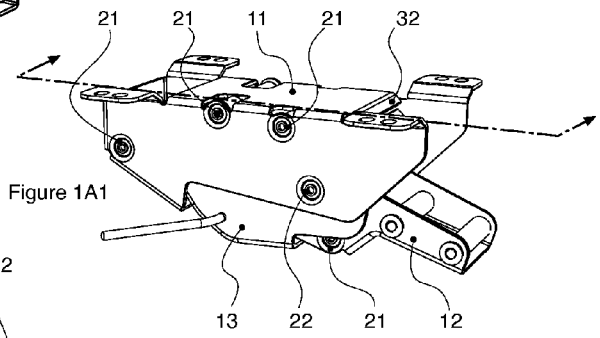
Figure 1A1
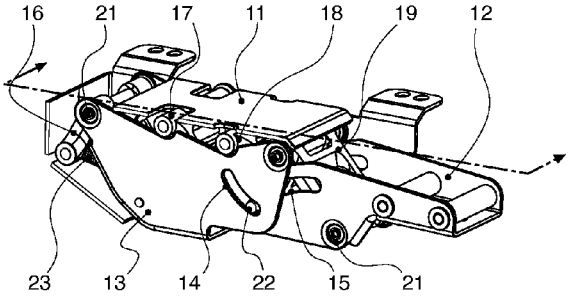
Figure 1B
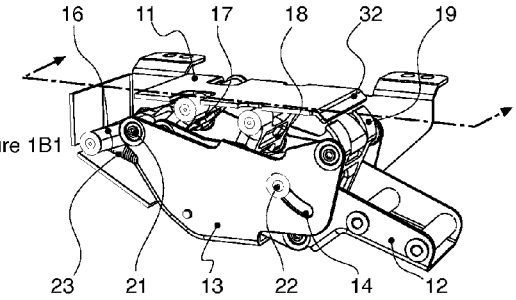
Figure 1B1
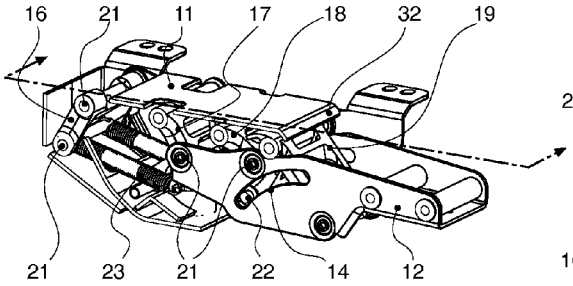
Figure 1C
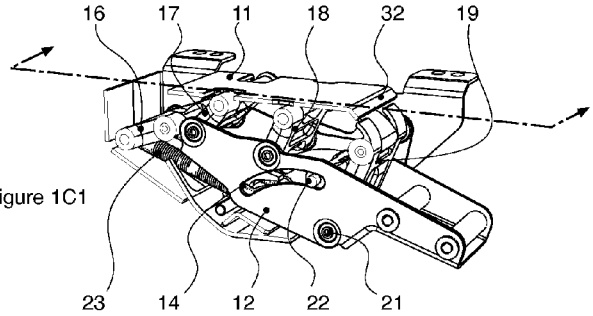
Figure 1C1

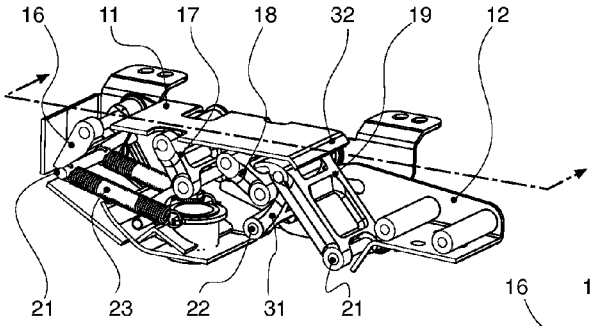
Figure 1D
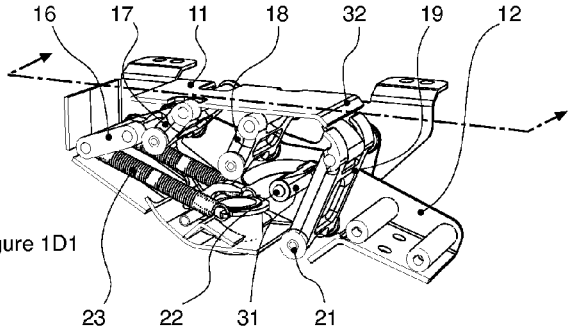
Figure 1D1
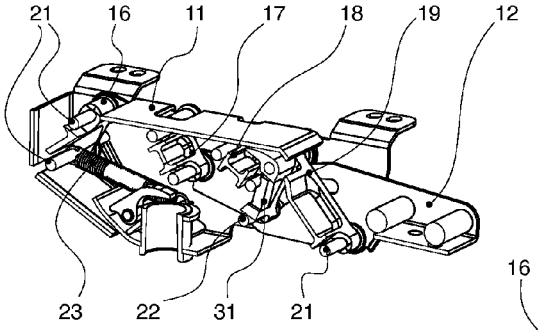
Figure 1E
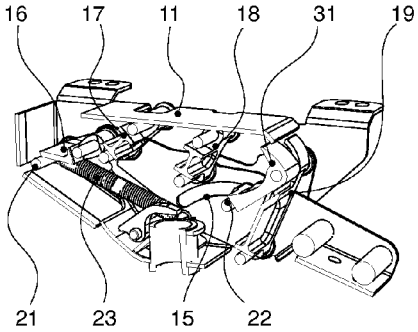
Figure 1E1

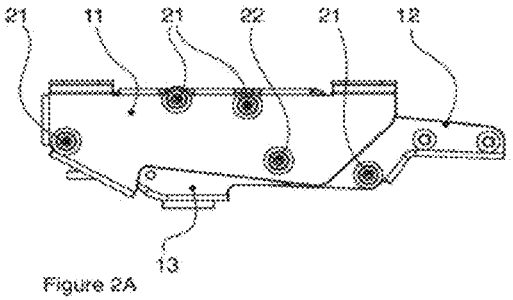
Figure 2A
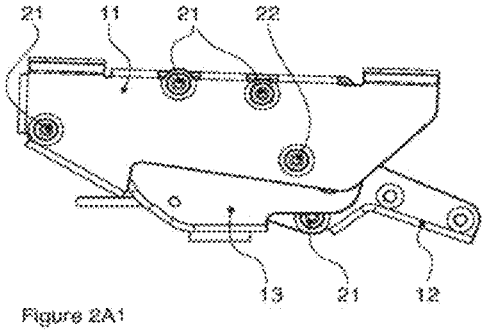
Figure 2A1
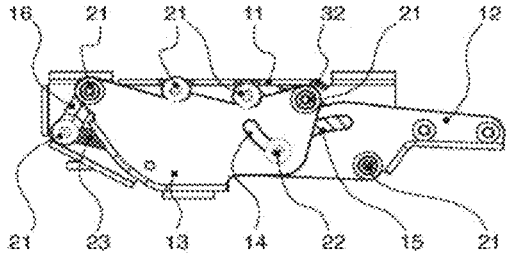
Figure 2B
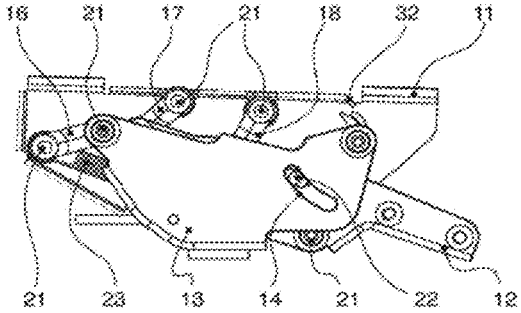
Figure 2B1
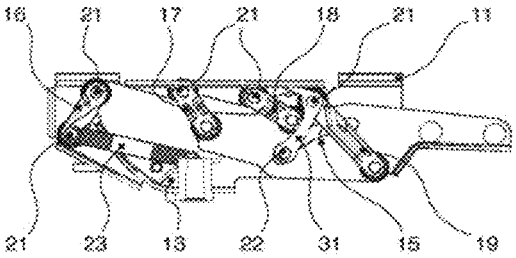
Figure 2C
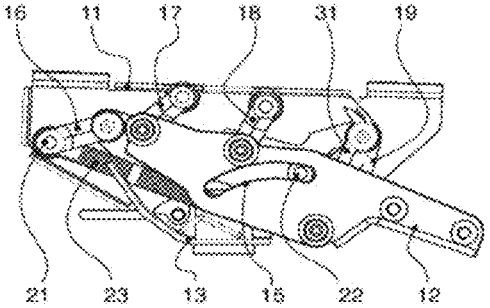
Figure C1

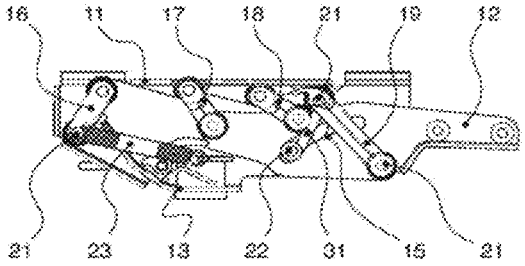
Figure 2D
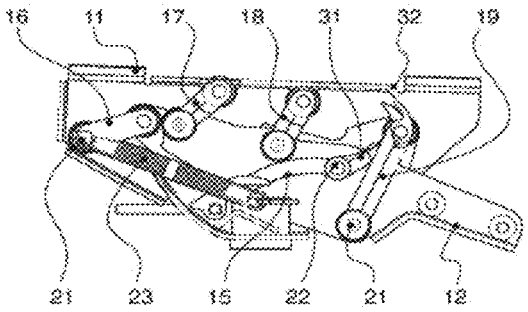
Figure 2D1
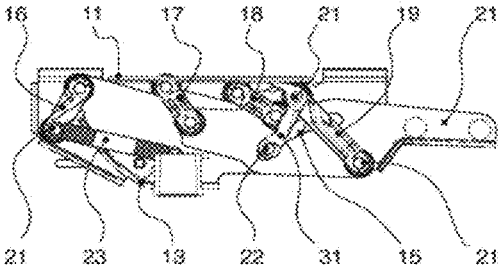
Figure 2E
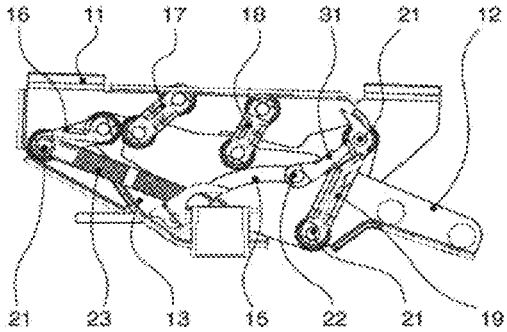
Figure 2E1

LINK CHAIR ACTION

CROSS REFERENCE TO RELATED APPLICATIONS

The present application is a national stage filing, pursuant to 35 U.S.C. Section 371, of International Patent Application No. PCT/GB2011/051706, filed 12 Sep. 2011, and through which priority is claimed to Great Britain Application No. 1015414.4, filed 15 Sep. 2010, the disclosures of which are incorporated herein by reference in their entireties.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION BY REFERENCE OF MATERIAL SUBMITTED ON A COMPACT DISC

Not applicable.

STATEMENT REGARDING PRIOR DISCLOSURES BY THE INVENTOR OR A JOINT INVENTOR

Not applicable.

FIELD OF THE INVENTION

This invention relates to chair actions and is particularly, but not exclusively, concerned with recliner chair actions to achieve a so-called 'Virtual Pivot' (VP) action; that is one unconstrained by chair component physical confines and one consistent or harmonious with the natural pivot action of a chair occupant's body.

BACKGROUND OF THE INVENTION

Recliner chair actions in which a seat and/or back are variously mounted for independent or interrelated mobility are numerous, but generally suffer from deficient performance, complexity and cost. The Applicant's past proposals to address and resolve these issues for such actions include WO2007/023301 n which seat occupancy and back recline forces or loads are counterposed and in a later design explored a multiple slide arranged for co-operative interlink and optimised motion; Challenges include mechanism simplicity and reduced component count for ease of manufacture, without compromising action subtlety, and set in a compact format.

STATEMENT OF INVENTION

Aspects of the invention variously embrace . . . .

A (recliner) chair action comprising a seat frame (11), a drive frame (12), a yoke frame (13), inter-coupled by a plurality of pivot links (16, 17, 18, 19), for floating mobility of seat upon yoke, with a facility for seat translation and/or tilt upon back recline operable under a potential energy function in an inter-relationship between back recline and seat movement, for a common or harmonious experience between different occupancy weights.

A chair action, with a movable seat frame (11), a drive frame (12) for effecting seat frame movement, and an underpinning yoke frame (13); intervening pivot links operative between frames, to contrive a combined pivot swing and translational slide action, and free-floating seat frame mobility, whilst conforming to a virtual pivot geometry consistent with occupant natural body pivot.

A chair action with links independently grouped, respectively between seat frame and drive frame and between drive frame and yoke frame.

A chair action with an ancillary tether or tie operative between frames.

A chair action with a tether connected at one end to the yoke frame and at the other end to the seat frame, with connections operative through a slot clearance in the drive frame.

A chair action with an inboard pair of links between seat frame and drive frame and an outboard links respectively between yoke frame and drive frame and between yoke frame and drive frame.

A chair action with co-operatively disposed fore and aft pairs of links imparting a fore and aft rocking motion for the seat frame.

A chair action featuring swing arm or pivot link inter-couple or interaction between principal elements of seat, back and ground or carrier frame, for motion translation, transposition or transfer between elements. One particular inter-couple geometry is configured for (virtual) pivot consistency or harmony with an occupant body, upon back recline to effect seat motion. A balanced or 'self-weighing' action allows occupant weight, weight shift and forces applied, such as through leg to floor contact, to be matched in a reciprocal way.

A broad challenge is to achieve subtle or complex (programmable) motion, but without attendant complexity in components or inter-coupling elements. So the number of links, along with their individual and relative spans and dispositions require careful selection for a prescribed action or motion. A link configuration could be regarded as a 'physical expression' of an analogue program or interface, to translate input action, such as back recline, into an output such as seat slide and elevation up a ramp incline. Even a modest change in an individual factor can have radical consequence, for better or worse, in relation to an intended outcome.

A link could comprise an elongate tie or strut, for tension or compression loading, or a more elaborate form or profile, such as with a curvature, 'dog-leg' offset displacement. Links could be multiple-ended and carry multiple pivots or bearings and (con)join multiple components in a multi-link array or chain. Thus, say, a bracket plate with splayed arms, such as in a spider format, could serve as an intermediary.

A particular (recliner) chair action comprises a seat frame (11), a drive frame (12), a yoke (or carrier) frame (13), inter-coupled by a plurality of pivot links (16, 17, 18, 19), for 'floating' mobility of seat upon yoke, with a facility for (modest) seat translation and/or elevation and/or tilt, upon back recline. Such links can be independently grouped, respectively between seat frame and drive frame and between drive frame and yoke frame. An ancillary 'tether', or restraint tie, can be operative independently between elements and can pass through clearance openings in, or between, components.

Such a so-called 'Link' mechanism can deploy groups or combinations of links, with fixed relative pivot axis dispositions. The links help stabilise, regulate or 'discipline' the action. The link rationalises the number of elements and moving parts. Some limitation might be regarded as a penalty or price for a 'tidier' action. Multiple links require more careful combination to achieve co-operative behaviour and to avoid impediments.

Whilst a 'link-only' mechanism can be contrived to work satisfactorily, supplementary slots (tracks, grooves, pathways or guideways) and respective followers can be employed in a lesser, ancillary supportive role. This to engender a certain flexibility in action freedom, by admitting compensatory mounting and drive tolerance or slackness. Put another way, a slide element allows a greater overall collective freedom of movement and a more complex action or motion profile; with blurred boundaries or 'fudge'. The action accommodates motion combinations for elements, which might otherwise come into mutual conflict and even jam or obstruct movement. Use is made of multiple individual guideway profiles and their co-operative relative disposition. The collective (movement) action is two-fold:

A. to control the interaction of principal chair elements (vis back and seat).

B. to control the movement in space of principal chair elements (vis back and seat).

this movement action is in relation to a static reference or ground frame or plane; represented, in the case of a pedestal chair, by an underpinning supportive carrier frame, such as one configured as a yoke with splayed radial arms about a central stem collar, to fit a pedestal base pillar upstand. For a side chair, a base frame supported by corner legs could serve as an underpinning support, with one or more objectives, such as:

1. to allow the seat frame to apparently 'ride' or 'float' freely, in the perceptions of a seat occupant.

2. to impart 'reassuring' resistance to back recline, by (reciprocal) counteraction with, or 'see-saw' counterbalance by, occupant weight.

3. to achieve a balance pivot 'consistent' or 'harmonious' with natural body pivot, taking account of upper and lower trunk mass distribution, as perceived by a chair occupant.

4. geometrically, a seat pivot coincident with back pivot.

5. to create a modest incremental forward and upward seat transition, upon/driven by back recline.

6. to keep the seat rear to lower back junction from coming together and pinching occupant; but to preserve a consistent seat inclination.

7. to provide support and 'constrained' mobility, within bounds;

8. an 'effortless' (or minimal effort) responsive, movement upon demand, gives an occupant a relaxed feeling of control; but with reliance upon constraints against unstable modes or behaviour.

9. reaction bias springs can slow or dampen movement in response to user demand.

10. a modest return bias action allows an automatic return to an un-displaced condition, whilst allowing some neutral interim balance, or neutral stability, between back and seat mobility.

Desired characteristics include factors such as:

1. a minimal number of principal elements.

2. principal elements 'mutually contained'; thus say, a seat frame sat astride ('static') yoke frame, but within the embrace of a back frame.

3. swing arms or pivot links between yoke frame and seat frame, of fixed relative pivot disposition, to stabilise or constrain mobility; more specifically, an outer group of) swing arms between seat frame and yoke frame; an inner group of swing arms between seat frame and drive arm or frame;

4. a supplementary or ancillary slot (groove, track, guideway or pathway) in the drive frame, a slot (groove, track, guideway or pathway) in the yoke frame, the drive slot and yoke slot mutually overlapping and being traversed by a common follower carried by a detent arm.

5. a key 'design driver or criterion' is a 'virtual pivot' action; i.e. commonality, consistency or harmony of seat and back combined pivots, along with 'natural body (effectively combined upper and lower trunk) pivot', outside the physical confines of the frames.

Generally, swing arm or pivot link rotation about pivot axes at opposite ends allows limited translational movement, in the plane of rotation about an orthogonal rotational axis; such as a vertical plane of rotation about a horizontal pivot axis. That is a severe constraint for a single arm, even more so for multiple, say paired, arms coupled to spaced points on a common element. A link action is thus of limited mobility or freedom of movement. So its use needs to be focussed and purposeful.

A 'rocking' action, can combine translational and rotational modes. Movement is in relation to a frame of reference, designated a carrier, yoke or 'ground frame'. One chair element, designated the carrier or yoke frame, can be 'locked' to that so the chair can sit still upon a stationery surface. For a pedestal chair, a yoke frame, as the basis for a pedestal chair column mounting, serves that role. The longitudinal span of splayed yoke arms suffices to support the fore and aft extremities of the seat and drive frames. Similarly, for a chair pedestal base. For side chairs, the carrier or yoke could simply become a bottom frame, of diverse form.

The relative disposition of frames; i.e. which sits within, outside, upon or alongside another, admit of some variation. VP action is not a natural or inevitable consequence of a link mechanism; rather an objective or target outcome and as such a limitation upon components and/or their mountings. Parts can be 'juggled' around empirically (conveniently by trial and error CAD modelling), until a desired result is achieved. An underlying formula, such as a mathematical potential energy scenario, can apply. Pivot rotation about a VP implies both vertical and horizontal components of movement; i.e. a seat moves upward or downward (somewhat) and along, (n relation to ground reference frame).

For analysis, with simplified role categorisation, the idea terminology of 'reaction' frames is introduced. Thus a reaction frame is (defined as) one against, or in relation to which, other frames are displaced. Reaction frames could be ranked within themselves, in a hierarchy, of primary, secondary or beyond, according to whether or not they are stationery/fixed, or themselves mobile. More specifically, a 'primary' reaction frame, in practice is likely to be a static ground or reference frame, such as the yoke frame for a pedestal chair mechanism. Whereas a secondary reaction frame, whilst also one against, or in relation to which, other frames are displaced; is itself displaceable in relation to a primary frame. Thus, say, for a seat frame displaced in relation to a yoke frame, the yoke would be a primary frame. However, for a seat frame displaced in relation to a drive frame, the drive frame would be a secondary frame; this would reflect the intermediary role of the drive frame.

Another factor introduced in relation to the present invention for mathematical analysis of chair action and relative displacement of principal elements, is that of potential energy associated with the effect of gravity upon mass elevation. A seat occupant is an example mass, subject to displacement upon seat occupancy; in particular elevation or lift and/or linear translation. Such potential energy considerations and calculations could be assessed for displacement(s) in relation to primary frame(s). A formulaic expression of action and attendant graphical plots can be derived for analysis and prediction, as contributory design tools for occupant input action and chair mechanism reactive behaviours. Internal (slide and/or pivot) friction effects can also be considered.

BRIEF DESCRIPTION OF THE DRAWINGS

There now follows a description of some supporting embodiments of the invention, by way of example only, with reference to the accompanying diagrammatic and schematic drawings, in which:

FIGS. 1A through 1E1 show three quarter side perspective views of a series of progressively cut-away 3D cross sections through a chair mechanism, to reveal successively more detail of inner components; a series of paired illustrations reflect a chair in back upright and back recline modes;

More specifically . . . .

FIGS. 1A and 1A1 show external three quarter side perspective view of a chair mechanism in back upright and tilt/recline positions respectively. A seat frame is shown outermost and uppermost, with an inset drive frame for back (not shown) mounting and an inner yoke for pedestal (not shown) mounting partially revealed;

FIGS. 1B and 1B1 show three quarter side perspective views of a chair mechanism in upright and back tilt/recline positions respectively. Side arms of seat frame are cut-away to reveal the inner rear seat guideway and back frame (drive frame) guideway. A front swing arm or pivot link between the seat frame and yoke is also visible.

Figure 3A:
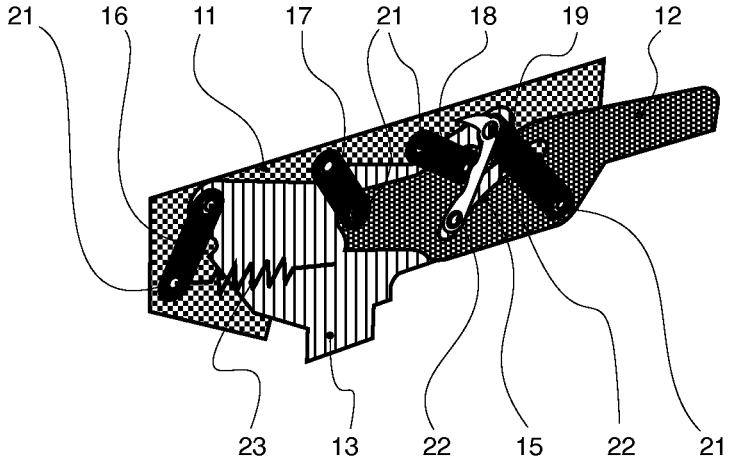
Figure 3B:
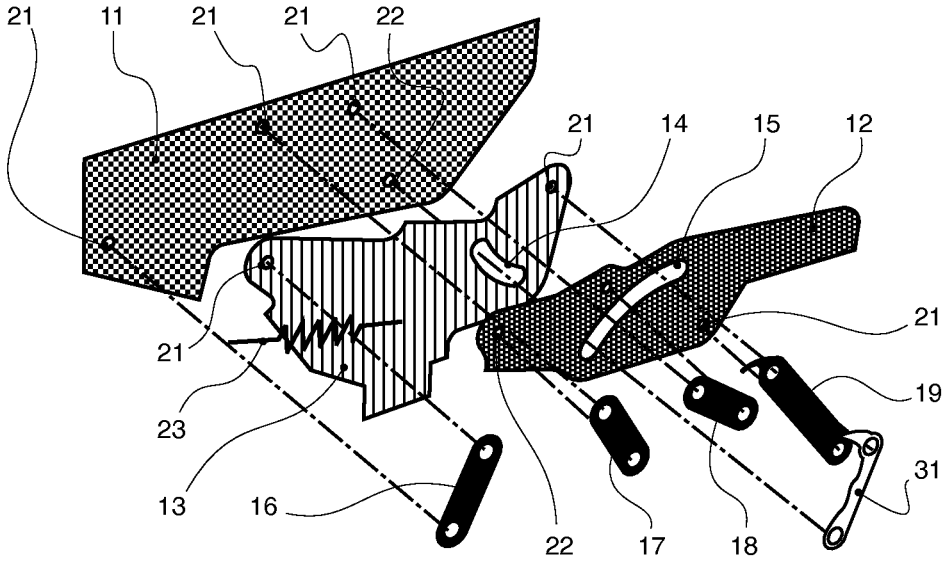

FIGS. 1C and 1C1 show three quarter side perspective views of a chair mechanism in upright and back tilt/recline positions respectively. The seat frame is now fully removed on the visible side, fully revealing the drive frame for back mounting at an outboard end and interaction with the static yoke though links and guideways;

FIGS. 1D and 1D1 show further cut-away three quarter side perspective views of chair mechanism in upright and back tilt/recline positions respectively. (Back) drive frame is cutaway to reveal internal (yoke) links and return bias springs;

FIGS. 1E and 1E1 show almost completely pared away three quarter side perspective views of a chair mechanism in upright and back tilt/recline positions respectively. Links have been omitted or part cut-away to reveal attachments points (on the yoke);

FIGS. 2A through 2E1 show progressive cut-away 2D side elevations of a chair mechanism with link end pivots in back upright and back tilt/recline positions; the sequence of paired illustrations reflects a 2D or flat side on version of the FIGS. 1A through 1E1 3D sequence;

FIGS. 2A and 2A1 show 2D external side elevations of an assembled chair mechanism with link end pivots respectively in back upright and back tilt/recline positions;

FIGS. 2B and 2B1 shows part pared away side elevations of a chair mechanism respectively in back upright and back tilt/recline positions;

FIGS. 2C and 2C1 shows further pared away side elevations of a chair mechanism respectively in back upright and tilt/recline positions;

FIGS. 2D and 2D1 shows more fully pared away side elevations of a chair mechanism respectively in back upright and tilt/recline positions;

FIGS. 2E through 2E1 shows fully pared away side elevations of a chair mechanism respectively in back upright and tilt/recline positions;

FIGS. 3A and 3B show simplified 3D figurative, 'sliced topological' depictions as overlaid 2D layers of principal action elements and their interaction; this to simplify the clutter of specific detail of the FIGS. 1 and 2 sequences;

More specifically . . . .

Figure 4A:
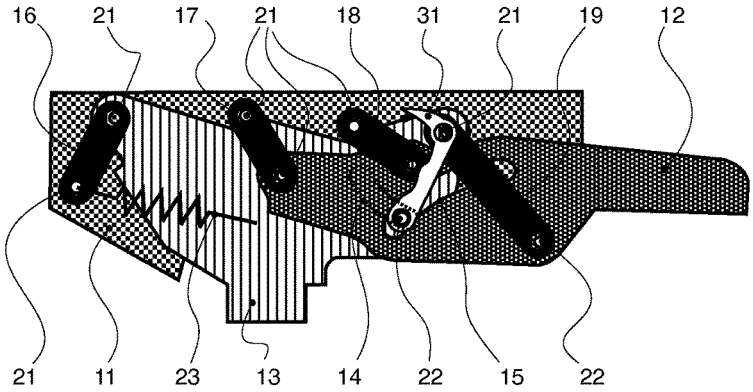
Figure 4B:
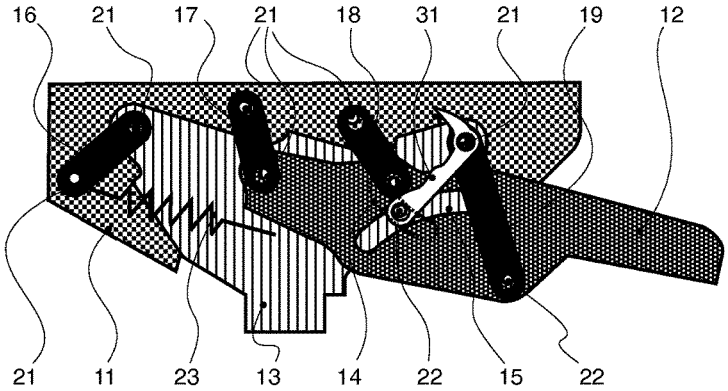
Figure 4C:
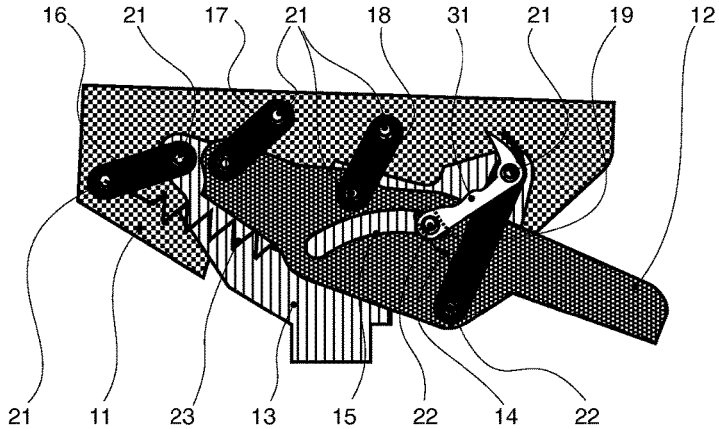

FIG. 3A shows juxtaposed principal elements of seat frame, drive frame and yoke frame, reflecting relative size and disposition, but not in strict or literal layer order; in practice the frames are mutually inter-nested and partially enshrouded by other elements;

FIG. 3B shows an exploded view of the elements of FIG. 3A, with broken lines representing their relative interconnections;

FIGS. 4A through 4C reflect the illustrative scheme of FIGS. 3A and 3B by sequential 2D topology diagrams of mutually overlaid principal chair elements, intervening links and interactions, from back upright through to back tilt/recline;

More specifically . . . .

Figure 5:
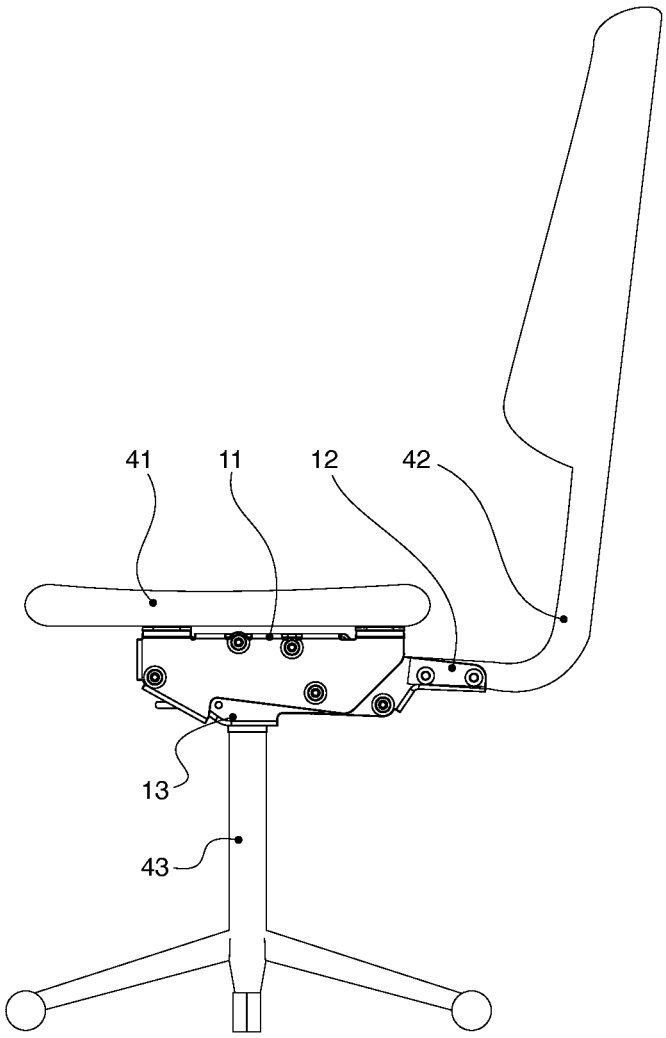

FIG. 4A reflects back upright with drive frame horizontal and seat frame lowered;

FIG. 4B reflects intermediate back recline, with drive frame canted downwards and seat somewhat elevated and forward translated;

FIG. 4C reflects full back recline, with drive frame full downward and outward swing, full seat elevation and forward transition;

FIG. 5 shows a simplified side elevation of an archetypal desk or office chair and pedestal fitted with a chair action for FIG. 1A FIGS. 6 through 10 relate to the Appendix;

More specifically . . . .

Figure 6:
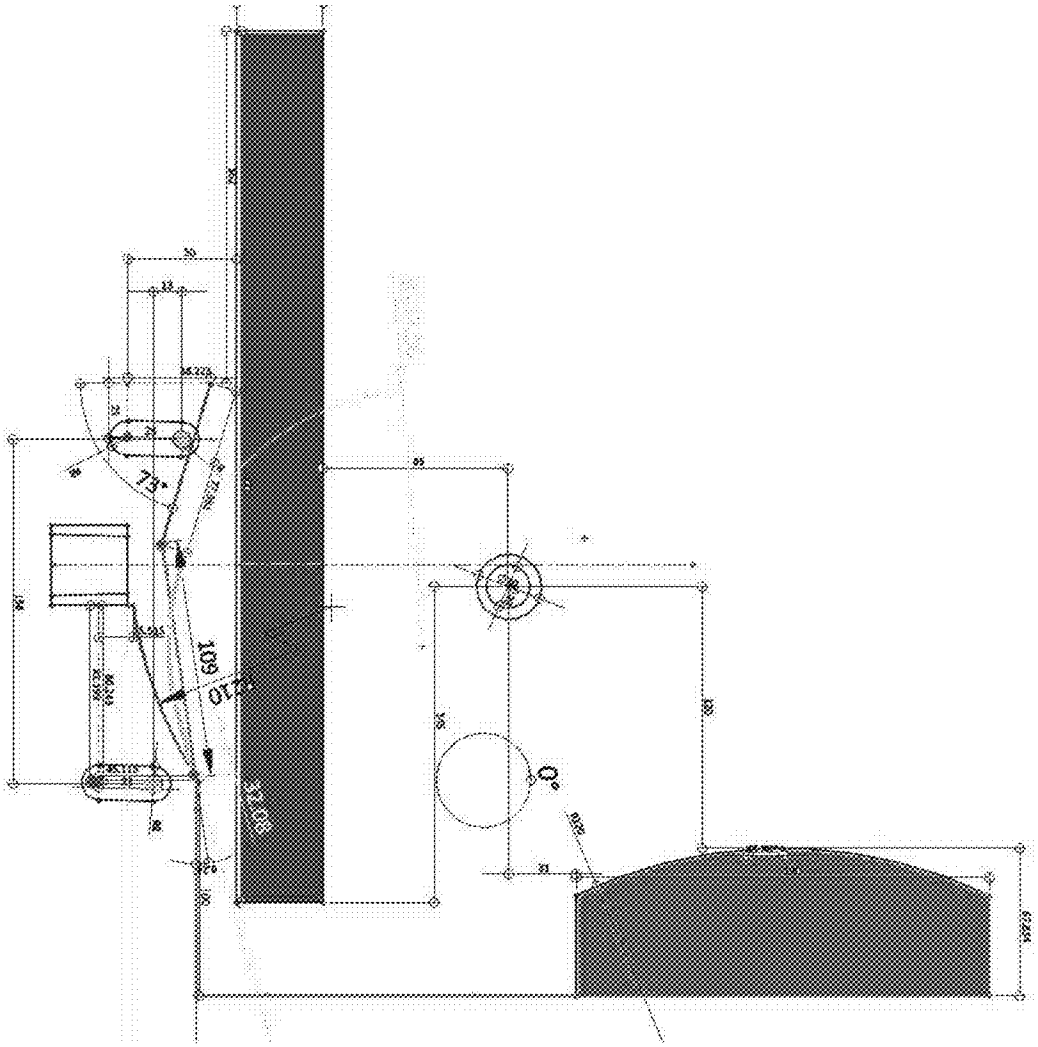
Figure 7:
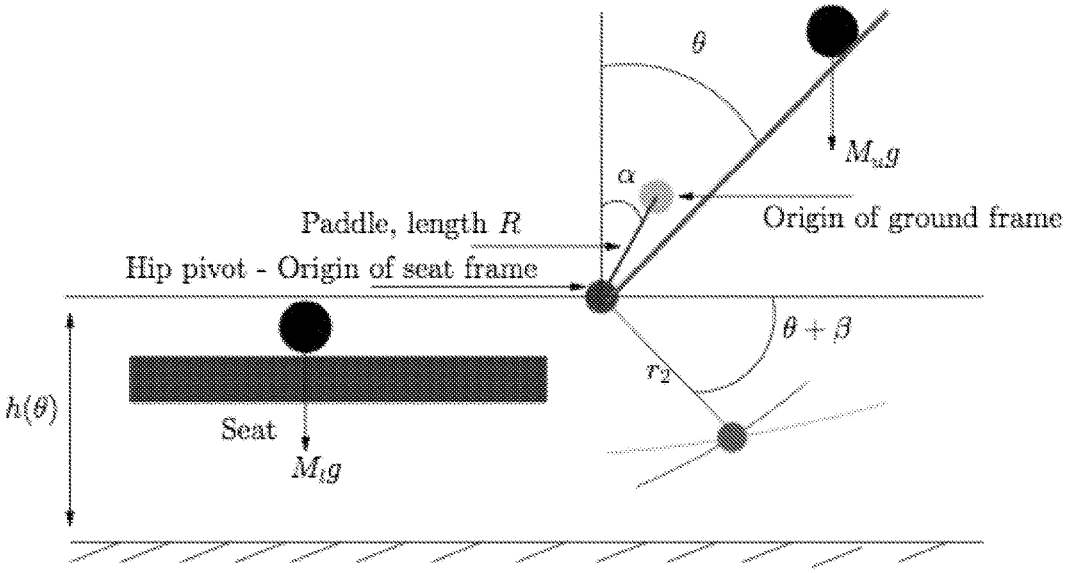
Figure 8:
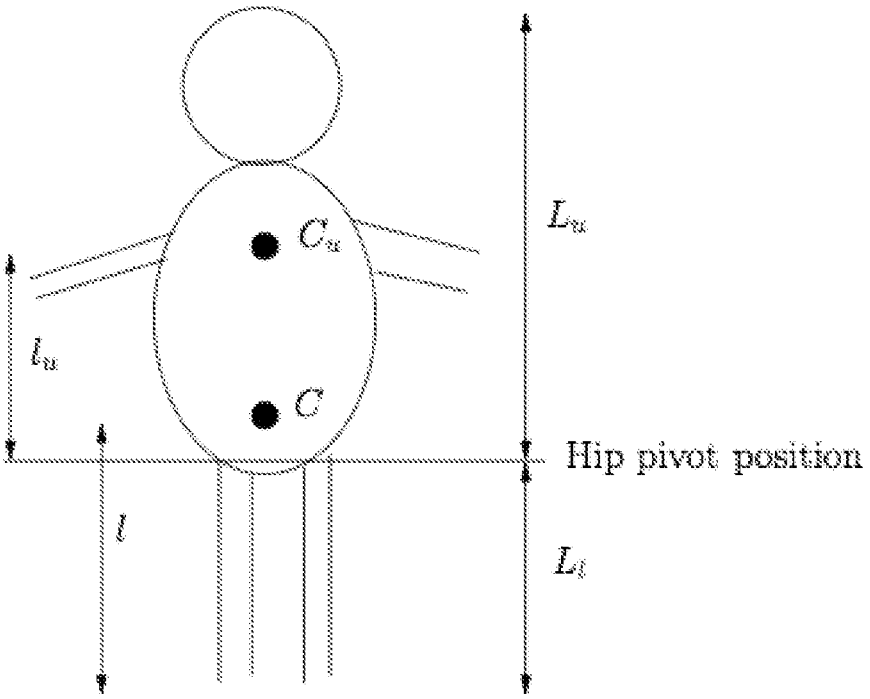
Figure 9:
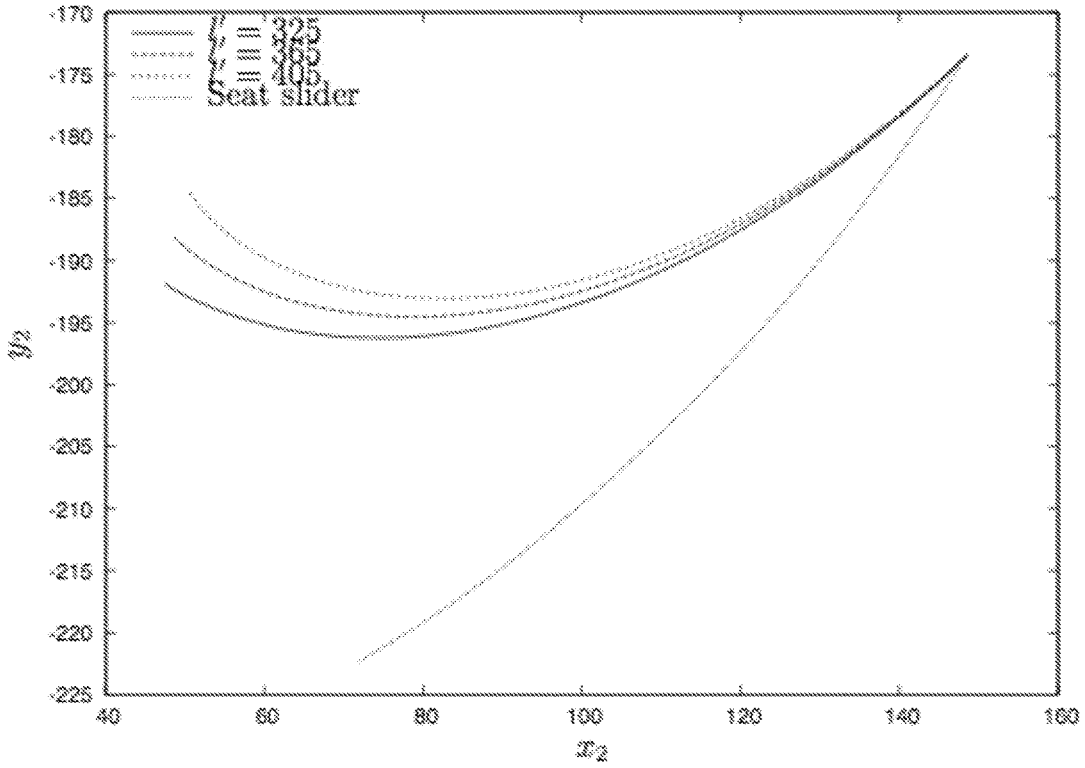
Figure 10:
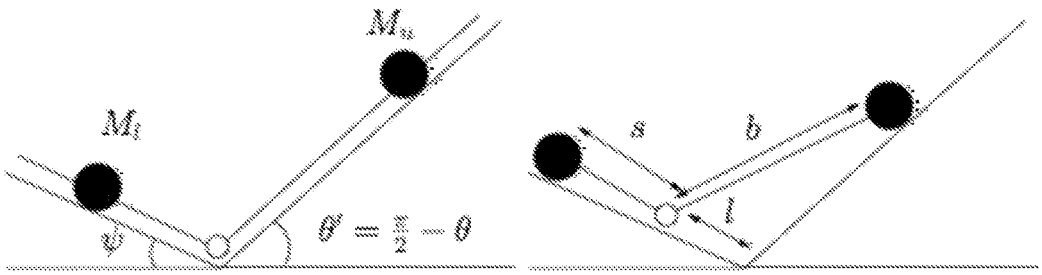

FIG. 6 shows a side view of an example chair, with principal elements and their interconnection, as representative initial geometry for analysis;

FIG. 7 shows a simplification of FIG. 6 force parameters;

FIG. 8 shows a typical human body, with relative lengths and positions of centres of mass for upper and lower trunks, and hip pivot position;

FIG. 9 shows action performance through graphic curves;

FIG. 10 shows an occupant in chair with a tilting seat with (right) and without (left) 'slouching', that is body spread or sprawl.

WRITTEN DESCRIPTION

Referring to the drawings, a chair mechanism is generally symmetrical about a longitudinal fore-and-aft centre line, so for convenience of reference, only one side at a time will be referenced, the other side being a corresponding or mirror image. That said, a single rather than twin-sided, action might be used in certain chair forms, such as at opposite ends of an elongate seat and back, as with a bench seating arrangement. However, the immediate concern here is with a pedestal chair format. The action features some three principal elements, namely a seat frame 11, a drive frame 12 and a yoke frame 13, variously inter-coupled by swing arms or pivot links 16, 17, 18, 19 and ancillary tethers or ties, such as slide-follower elements described later.

Yoke frame 13 can be regarded as a notional reference 'anchor' to a static ground plane (not shown). Seat frame 11 and drive frame 12 are free to move in relation to yoke frame 13, to a certain extend independently, but subject to certain imposed inter-coupling constraints. The respective mobility of seat and back is to allow a geometry paying attention to a VP agenda. Back mounting rotation can thus be about a common VP as seat rotation and the natural pivot of an occupant's body. The relative dispositions, travel arcs, or slide motions of the intervening links 16, 17, 18, 19 determine the overall nature and range of chair seat and back movement for a chair occupant, user or sitter in relation to the underpinning yoke frame 13. The latter can be treated as static for the purpose of analysis of seat and back motion, but in practice could itself be mounted on a mobile pedestal base 43, in an office or desk chair format.

The upper end of seat frame 11 carries spaced mounting lugs for overlaid seat cushion 41 attachment. Seat frame 11 is of inverted 'U' or 'C' section, configured as a 'saddle' to ride over an inner frame assembly and to present depending side walls, in which are located upper and lower pivot end bearings 21 of swing arm or pivot links, arranged as an inboard pair 17, 18 and an outboard pair 16, 19. Drive frame 12 is also of 'U' or 'C' section, to present opposed side wall up-stands to carry lower pivot ends 21 of links 17, 18. A back frame 42 is secured to the rear outboard end of drive frame 12, as shown in FIG. 5. Yoke frame 13 has an upper end of opposed upstanding arms located between the upstanding drive frame 12 side arms.

A tie bar, or tether link 31 is operative between a rearward extremity of yoke 13 through an upper pivot 21, also in common with a rearward depending link 19. The lower end of link 31 carries a roller follower 22 located in an arcuate slot 14 in drive arm 12 side walls and also an arcuate guideway slot 15 in the drive frame 12. Guideway slots 14 and 15 marginally overlap intermediate their respective pathways. The relative overlap or intersection at follower 150 changes with chair disposition, as reflected from a back fully upright condition of FIG. 4A, a part-recline condition of FIG. 4B and a fully-reclined condition of FIG. 4D. Alternatively, a tether could be operative between elements, such as yoke and seat frames, with clearance from other elements, such as drive frame.

A 'dual interlaced' mobility of action is achieved; firstly in relation to carriage of the seat frame 11 upon drive frame 12, through the intermediary of inboard swing arms or pivot links 17, 18; and secondly and (almost) independently in relation to carriage of drive frame 12 upon yoke frame 13, through the intermediary of outboard link 19. A mutual inter-couple constraint, by conjoining the otherwise discrete motion modes, is imposed by interposition of a 'through' roller follower 22 carried at the lower end of link 31 and which runs in arcuate slot 15 in the drive frame 12 and in arcuate slot 14 in the yoke frame 13, alongside being carried by seat frame 11. Link 31 is also operative as an over-latch, with a capture detent 32 to limit overall travel range.

The seat frame 11 can ride 'fore-and-aft' and 'rock' about inboard swing arms 17, 18 upon the drive frame 12. The drive frame 12 can also ride 'fore-and-aft' and 'rock' about outboard swing arms 16, 19 upon the yoke frame 13. A complex composite motion can be achieved, yet the components admit of individual adjustment. Subtle and yet well-prescribed motions can be imported in a see-saw counterbalanced action. An occupant experience is thus of 'floating reassurance'.

Freedom of movement of an individual link is impacted and constrained by that of another link. Initial cant or inclination, absolutely and/or relative to others, of individual links and their groupings 17, 18 and 16, 19 has a bearing upon their freedom of movement, such as motion arc limit. The analysis is complex, particularly when other contributory freedoms are introduced, such as pivot slides, but can be mapped on a solid modelling CAD/CAM program.

Links and their respective pivot ends, can be subject to lengthwise tension or compression and transverse shear loading; as link rotation can be accompanied by a longitudinal and vertical motion of a link end pivot. Relative orientation also affects initial motion susceptibility and directional tendency upon seat occupancy and/or back recline. The relative juxtaposition of links can effectively freeze 'un-commanded' element mobility.

A return bias spring assembly 23, conveniently paired coil springs set longitudinally, is operative between a chair chassis, such as yoke frame 13 and one of the movable frames, such as seat frame 11, to offer modest controlled resistance to back recline and seat forward slide and also to contrive an automatic return to an u-displaced condition, such as when an occupant relaxes (i.e. with feet lifted up from the ground to offer no initiation or resistance to chair motion), or leaves the chair altogether.

Exploratory empirical data suggests that a virtual pivot (VP) point, representing the 'natural' human articulation hinge or hip joint can be emulated by a mechanism, for a wide range (if not all) heights and masses. For a chair that will be comfortable for anybody to use, so chair movement ensures complete contact and support during recline more formalised applied mathematical formulae have been developed, giving consideration to percentile height and weight differentials against a virtual pivot point. This is expanded upon in an Appendix.

For compliance with user comfort and reassurance, the back and seat can be mounted to rotate about a common, nominal 'virtual pivot'—i.e. one outside the physical confines of the elements—coincident with the hip pivot point of a seated occupant. Pivot location can be a 'design driver' or at least a significant design consideration, in mapping the mounting and movement freedom of the back and seat, using a standardised ergonomic model or occupancy.

Disposition of links at opposite seat (frame) ends allow a 'floating' support fluidity' and selectively constrained mobility action. Thus, a certain longitudinal mobility, is combined with variable seat height determination. The latter can be expressed or analysed in terms of 'potential energy', which is related to the effect of changes in occupant height under gravity loading. This is the work done or output of the mechanism, which is in turn a consequence of the work input through back recline. A graphical plot of seat elevation with back tilt angle can be plotted as a form of potential energy function. A kind of 'seesaw' balance can be contrived. Whilst not precluded, a level seat movement would present minimal work output and would not present an occupant optimally, say to a desk or task in the case of a pedestal office chair. Abrupt transitions, even discontinuities, in movement path can be contemplated, such as to impart temporary local resistance to back recline.

An 'interlaid' mobility is employed between seat frame 11 and yoke frame 13, through the intervention of the drive frame 12 and respective inter-couples. Seat frame 11 is carried by inboard links 17, 18 upon drive frame 12. Seat frame 11 is tied or tethered to the yoke frame 13 by a forward or foremost outboard link 16. The drive frame 12 is tethered or tied to the yoke frame 13 by a rearward or rearmost link 19. A return bias spring 23 is operative between forward link 16 and yoke frame 13 body at a central region, not shown.

A floating tether or tie link 31 is carried at is upper end upon a pivot 21, in common with rearward link 19. The lower end of tie link 31 carries a 'common' or dual action roller follower 22, which traverses overlapping curved guideway slots 15, 14 respectively in the drive arm 12 and yoke frame 13. The drive frame 12 is constrained by inboard carrier links 17, 18 and rearward outboard link 19, but is free to float somewhat, by tilt and translation about rearward link 19 in relation to yoke frame 13, under forces applied to a rear-mounted back, whilst transmitting the effect forwardly to the seat frame 11 through inboard links 17, 18. The seat 11 thus moves forward and upward somewhat, in response to back rearward tilt or recline.

Tie link 31 constrains the path of drive frame 12 motion by tracking the paths of guideway slots 14, 15 with dual pathway follower 22. Full back recline occurs with drive frame 12 full (clockwise as shown) rotation and forward translation, with attendant elevation and forward travel of seat frame 11, is depicted in FIG. 4C. A 'neutral' back full upright condition is reflected in FIG. 4A, with drive frame 12 sitting more level and rearward and seat frame 11 settled lower and more rearward. In the full back recline condition, follower 22 at the lower end of tie 31 has reach a rearward extremity of its travel in arcuate guideway slot 15 in drive frame 12 and a forward extremity of its travel in arcuate guideway slot 14 in yoke frame 13 An upper latch or detent (not shown) 32 can be operative upon upper end of tie 31 to limit or lock motion range. The pivot ends 21 of links 16, 17, 18, 19 can be plain bushes or more elaborate roller bearings to ensure freedom of movement.

Informal colloquial terms, such as 'sea-saw', 'rock and roll', 'pivot glider' or 'self-weigh' can be used on occasion, as convenient short-hand reference for chair action and its attendant motion or mobility; but in reality a complex combined or multi-component movement path can be achieved and moreover one that is predeterminable and indeed programmable by adjusting element profiles, proportions, positions and pathways. Both element mounting and interaction have an 'overlaid' mutual impact upon outcome, as a movement in space and occupancy experience in continuous transition or progression over a prescribed range. Programmable non-linear effects can be incorporated, so the stages of back recline can produce different effects upon seat disposition. Thus replacement of an element with different guideway profiles can change the inter-couple or seat and drive frames. A distributed carriage or support of elements from others, themselves variously supported, allows a subtlety and fluidity in mobility. The 'effort expenditure' of back lean input is converted to seat forward translation and a certain elevation output, counter to occupant weight.

Ultimately, a frame assembly may need to react with a fixed frame of reference such as a ground plane; but within the frame assembly frames can react between themselves and so termed reaction frames to transfer a net movement.

The forward end of seat frame 11 describes a path dictated largely by rotation through an arc of forward link 16 about its upper pivot 21 mounting in forward end of yoke frame 13. The mid-position of seat frame 11 reflects its intermediate carriage by swing links 17, 18 upon the forward end of drive frame 12, itself hung from yoke frame 13 by rearward link 19, subject to the 'range bounds' of follower 15 in guideways 14, 15.

Back mounting is through an offset or dog-leg displacement bracket 42 configuration, so drive frame 12 is the bottom bar of a 'composite L' frame, with the back as an upright; and which both tilts and translates as an assembly. Seat frame 11 can ride up over and forward beyond the reach of the drive frame 12 forward end. The effect of recline, in conjunction with seat elevation, provides the occupant perception of chair response.

The principal elements of seat frame 11, drive frame 12 and yoke frame 13 are mutually inter-nested within a common compact span or footprint and a modest overall depth, so the mechanism can sit unobtrusively beneath a seat, whilst allowing pedestal installation and telescopic height adjustment range. The particular yoke frame 14 format shown is configured for mounting upon a pillar or stem of a pedestal 'office' or desk chair, but could readily be adapted for a side chair, such as with splayed legs at each corner.

COMPONENT LIST

11 seat frame
12 drive arm
13 yoke
14 (yoke) guideway
15 (drive arm) guideway
16 front swing arm
17 (inner front) swing arm
18 (inner rear) swing arm
19 (rear) swing arm with catch/detent
21 pivot
22 follower
23 spring
24 back frame
25 Side leaves of seat frame
43 pedestal
41 seat cushion
42 back cushion

APPENDIX

1.1 Background

Sitting in office swivel chairs is a common experience; most have a wide array of adjustments to enable each user to set them up to their individual preferences. As a chair reclines, normally a series of springs extend or compress to resist motion. An 'intuitive' solution has been developed according to some aspects of the present invention to make the 'experience' more comfortable by using the occupant's or sitter's mass to resist motion, rather than springs, but its effectiveness is difficult to quantify. That is, when sitting and leaning back, the occupant's mass balances with the force applied to the chair back by raising the seat, as opposed to the traditional approach of compression springs. In addition, the movement of the seat acts as if there was a 'virtual pivot', which represents a natural human hinge point, the hip, and ensures complete contact/support for the occupant during the reclining cycle with associated back support benefits. One ambition is to contrive a chair with a minimum of adjustments, that will be comfortable for anybody to use. Empirical data suggests that a mechanism achieving this can work for a wide range of heights and masses, subject to a more rigorous analysis.

Challenges are:

to develop a model be to consider what Human percentile will receive the same effect as they recline and return to neutral rest;

to consider if the current geometric set-up is a true reflection of the forces in play, and if this geometry be altered to achieve a more efficient result.

There are also frictional forces in the mechanism to consider; their interaction with the process needs to be better understood, allowing for alteration during manufacture. So it is useful to determine if controls could be added to the chair to increase, or decrease, the effects experienced by the occupant in a desirable way i.e. by altering friction or the geometry of the mechanism. 'Core Stability' can be improved by making the occupant work to return to an upright position, so it is not necessarily true that the best chair is one where the least effort is required).

1.2 Problem

To determine if a chair design can be adapted, so that a sitter or occupant pivots at or about their hip and remains neutrally stable as they recline in the chair.

2 Designing a Neutrally Stable Chair

FIG. 6 shows an initial chair geometry under consideration. A chair back and seat both move relative to the ground and fixed components of a chair. They are all connected via a system of sliders that couple the motion of the chair back and seat. As the person on the chair (the 'sitter' or occupant) reclines, this mechanism causes the seat to rise in such a way that the seat remains horizontal, and that the sitter pivots at their natural pivot point, the hip. In FIG. 6, certain parts of the mechanism are fixed relative to the ground, some are fixed relative the chair back and others are fixed relative to the seat. As an occupant reclines, the back mechanism under the seat moves along the sliders, which are fixed relative to the ground and seat respectively. As the co-incident point between the sliders moves, the angle of the 'paddles' (that is the stadium shaped devices beneath the seat) must change and this movement raises the seat whilst keeping it horizontal; it also induces a horizontal translation.

The hip pivot of the sitter, shown as concentric circles in the middle of FIG. 6, is intended to remain in the same place throughout the recline of the chair back. This is achieved through the choice of shape of the sliders, ensuring that the relative motions of the back and seat are related in the correct way. This is not perfectly realised at present due to other design constraints, but it is very close. In a starting point chair design, the curves are the arc of a circle and a straight line. The challenge is how to choose a curve, within this existing chair design, to achieve a neutrally stable chair, where sitter or, occupant keeps the same potential energy for all reclining angles, as well as pivoting about their hip.

To ensure that the virtual pivot is at the hip throughout the recline, and for mathematical simplicity, in the analysis that follows it is assumed that both the curves are arcs of a circle. With this simplified design both paddles are identical and only one need be considered if the intention is to keep the seat horizontal. Seat tilt this can be introduced with by different design paddles and is discussed briefly in Section 5. Also for mathematical simplicity, without loss of generality, it can be assumed that a paddle is located at the hip pivot point. A simplified chair geometry is shown in FIG. 7. It is additionally assumed that a seated person or occupant can be represented by two centres of mass; one upper-body mass, located a distance lu from the hip (pivot point) and the other, lower-body mass located a distance ll from the pivot. The total mass of the sitter M is divided into an upper-body mass Mu and a lower-body mass Ml. Details of the range of typical values of these are discussed in Section 3. The angle of recline of the back is given by θ, with θ=0 corresponding to the sitter being upright.

The various chair design parameters marked on FIG. 7 are: R, the length of the paddle; α, the angle the paddle makes with the vertical; $r_2$, the radius of the circular arc that the chair back runs along (the blue curve); β, the angle below the horizontal of the start of the circular arc when the chair is upright; and h(θ), the height of the sitter's hip above the ground. When the chair is upright at θ=0, the initial paddle angle is taken to be $\alpha=\alpha_0$.

FIG. 7 shows a simplified chair design with parameters. As the chair reclines and .theta. increases the red point moves along the two sliders (green and blue). This causes the paddle to rotate and, as a changes, the seat height changes.

For a starting point chair design these values are approximately given by . . . .

$$R = 25 \text{ mm},$$

$$\alpha_0 = 0,$$

$$r_2 = 210 \text{ mm},$$

$$\beta = \frac{\pi}{4},$$

although β may well be somewhat larger in reality. An objective is to try and find a suitable curve that makes the chair neutrally stable.

The potential energy of the sitter with reference to the origin of the ground frame, is given by . . . .

$$PE = Mgh + M_u g l_u \cos\theta$$

$$= Mg(h + l')\cos\theta$$

where the parameter $$l' = \frac{M_u}{M} l_u$$

is person dependent. Ranges of values of l' are discussed in Section 3. An aim is for a given person with characteristic l', to find the curve such that . . . .

$$h+l' \cos\theta = h_0,$$

where $h_0$ is a constant related to the initial potential energy of the sitter.

Two coordinate systems are introduced; one fixed to the ground, given by (x, y), and one fixed to the seat, given by (X, Y). Their origins are as given in FIG. 7 and the two coordinate systems are related by . . . .

$$x = X - R\sin(\alpha),$$

$$y = Y - R\cos(\alpha),$$

where α is the angle made by the paddle to the vertical and the height of the seat relative to the ground h is given by As it is assumed that the two sliders the chair runs along are both arcs of the same circle, only one of them need be considered and, relative to the seat coordinates (centred at the hip), the curve is given in parametric form by . . . .

$$X_2=r_2\cos(\theta+\beta)$$

$$Y_2=-r_2\sin(\theta+\beta)$$

or $$x_2=r_2\cos(\theta+\beta)-R\sin\alpha,$$

$$y_2=-r_2\sin(\theta+\beta)-R\cos\alpha,$$

relative to the ground. A potential energy constraint that requires . . . .

$$-R\cos\alpha+:'\cos\theta=h_0$$

$$=l'-R\cos\alpha_o$$

It is therefore known how the paddle must move to maintain a constant potential energy and this implies . . . .

$$R\cos\alpha=R\cos\alpha_0-l'(1-\cos\theta),$$

$$R\sin\alpha=\sqrt{R^2-(R\cos\alpha_0+l'(\cos\theta-1))^2}$$

Combining the above produces a parametric equation for the curve as . . . .

$$x_2=r_2\cos(\theta+\beta)-\sqrt{R^2-(R\cos\alpha_0+l'(\cos\theta-1))^2} \quad (1)$$

$$y_2=-r_2\sin(\theta+\beta)-R\cos\alpha_0+l'(1-\cos\theta) \quad (2)$$

This is the equation of the curve required, for a person with characteristic l'. Depending on the parameters involved, the square root on the right hand side of (1) could become complex. This corresponds physically to the chair being unable to lift the sitter enough to maintain a constant potential energy. The design will need to ensure R is large enough for the range of l' values of interest such that this square root always remains real.

As R is small compared to l' and $r_2$ it is expected that (1)-(2) are approximately equivalent to . . . .

$$x_2\approx r_2\cos(\theta+\beta),$$

$$y_2\approx -r_2\sin(\theta+\beta)+l'(1-\cos\theta).$$

It can be shown that this corresponds to the arc of an ellipse.

3 Human Data

FIG. 8 shows a typical human showing the relative lengths and positions of centre of mass. l.sub.0 is the height of the upper body centre of mass C.sub.0 and l is the height above the ground of the whole body centre of mass C.

To determine behaviour of the chair, it is needed to find the range of l' values that are typical in the population. The aim is that the chair will behave similarly for all users, regardless of shape and size, and that all users can obtain the same experience from the chair with the minimum of adjustment. The analysis above suggests that the neutrally stable curve given by (1)-(2) is person dependent. In a simplified model of a human it is needed to determine the position of the centre of mass of the upper body and how the typical mass is distributed between upper and lower body. General population data is quite hard to find, and the sources uncovered were all seemingly based on the same data set given in the FAA Human Factors Design Guide [1]. This gives average distributions of mass and location of centre of mass as a proportion of height. Also found are ranges of data measuring relative body lengths as part of the NASA manned system standards [2]. A further data set is to be found in [3], but is based on measurement of US marines and so may be less representative of the population as a whole.

The total body length is taken as by $L=L_u+L_l$, where $L_u$ and $L_l$ are the lengths of the upper and lower body respectively. Similarly the total mass is taken as $M+M_u+M_l$, where $M_u$ and $M_l$ are the mass of the upper and lower body respectively. These measurements are shown in FIG. 8 and, according to the data, are given as $$M_u=\frac{2}{3}M$$

$$M_l=\frac{1}{3}M$$

Position of COM of whole body $C=0.55\ (L_l+L_u)$ $$l_u=\begin{cases}0.66\ L_u \text{ armless,}\\ 0.616\ Lu \text{ with arms at sides.}\end{cases}$$

Position of COM of upper body $$L_u=\begin{cases}914 \text{ mm average male. Range 855-972 (5-95}th\text{ percentile)}\\ 851 \text{ mm average female. Range 795-910 mm (5-95}th\text{ percentile)}\end{cases}$$

It should be noted that these upper body lengths $L_u$ relate to the height above a seat when sitting, rather than a definition which is height above the virtual pivot point, roughly the hip. This reduces our effective $L_u$ by around 50 mm. Also ignored is the complication of arm position, by assuming the 'armless' value of $l_U$.

The parameter important for chair calculations is given by . . . .

$$l_u=\frac{M_u}{M}l_u,$$

$$=\frac{2}{3}0.66\ L_u$$

This gives a range from around l'=325 to l'=405 to cover the 5th to 95th percentile of both male and female sitters.

4 Sample Curves

FIG. 9 shows required curves for varying l' values compared to the arc of the seat slider for the chair in an upright θ=0 position.

This information can now be used to predict the ideal curves to achieve a neutrally stable seat. A curve is given by (1)-(2). Keeping the existing chair design parameters, it is taken that R=25 mm, $\alpha_0=0$, $r_2=210$ mm and if is also assumed that $\beta=\pi/4$ (although in reality it is somewhat larger than this on the plans considered during the study group). The required curves to achieve neutral stability are shown in FIG. 9. A maximum assumed tilt of $\theta=25o$ three cases are presented, $l'=325$ corresponding to the smallest female within our range of interest, $l'=365$, an average adult user, and $l'=405$ for the largest male user. The arc of the circle fixed with the seat is also shown for comparison. Notably, the difference between each of these curves is not large.

The 'perfect' or optimised curve to ensure neutral stability changes depending on the sitter. Given that one of the overall aims of the current seat design is to try and ensure all users have a similar experience of using the chair without having to make a myriad of adjustments, it is of note how much difference there is in the potential energy change for a sitter on a seat optimised for a different user. If a seat is 'perfect' for a sitter with a characteristic $\hat{l}'$, the question arises of how it behaves for different user with characteristic $l'$ and mass M. In this case the change in potential energy [PE] of the sitter as the seat reclines is given by . . . .

$$[PE]=(l'-\hat{l}')(1-\cos\theta)Mg$$

as the seat reclines and .theta. increases.

5 Some Considerations on Seat Tilt

FIG. 10 shows an occupant in a chair with a tilting seat with (right) and without (left) 'slouching'.

One issue is if tilting of the seat is desirable. Experiments to examine how performance is affected when friction between the sitter and the seat is removed (or at least reduced) reveal difficulty in staying on the seat if it always remains horizontal. This leads to considerations of what angle the seat (front) needed to raise or tilt to in order to avoid this tendency to slip or slouch in the chair.

The following is briefly to consider a much simpler, more abstract design to investigate the importance of seat tilt; this is set out in FIG. 5. For this purpose it is again assumed that the sitter can be represented by two point masses joined through a pivot located at the hip. The legs are replaced by a point mass Ml located a distance s from the hip and the body is replaced by a point mass Mu located a distance b from the hip. It is assumed that contact between the sitter and the chair only occurs at the centre of masses. If the sitter slouches, their hip moves from the corner and translates along the seat a distance l. To avoid slouching it is necessary to ensure that the hip remains at the corner of the chair back and seat. The potential energy of the sitter is given by . . . .

$$\frac{V}{g}=(s+l)M_l\sin\psi+\left(-l\cos(\theta'+\psi)+\sqrt{l^2}\cos^2(\theta'+\psi)+b^2-l^2\right)M_u\sin\theta'\sim\text{constant}+l(M_l\sin\psi-M_U\cos(\theta'+\psi)\sin heta')\text{ for 'small' }l.$$

to avoid slouching it is necessary to ensure that . . . .

$$M_l\sin\psi>M_u\cos(\theta'+\psi)\sin\theta'.$$

so that not slouching is the lowest energy state. If it is further assumed $M_l<<M_u$ (somewhat dubiously) $\cos(\eta/2-\theta+\psi)<0$ which implies $\psi>\theta$ to prevent slipping.

6 Other Factors to Consider

For a slightly simplified chair design a required 'shape' or profile of 'mobility map' can be derived to ensure the chair is neutrally stable for a given sitter. This is not quite the whole picture, as allowance also needs be made for the contribution of the chair parts (the potential energy of sitter being constant does not ensure the potential energy of the combined sitter and chair are constant). The most desirable design of chair for the general population can be considered, given that it can only be fine tuned for a fixed $l'$ value. If the desire is to ensure the sitter has to work to return to the upright position, it may be desirable to ensure that the potential energy is reduced for all users during reclining and increases when the sitter returns to upright. There are many other things that could be of considered. These include:

Detailed Mechanics/'Feel' of Sitter on Chair (Difficulty of Indeterminate System with Friction)

The sitter or occupancy experience when sitting on and operating the chair is a consideration. In particular, how in a given occupancy disposition the sitter applies forces to the back and seat of the chair to enable it to recline and how the sitter uses their own body weight or weight-shift to resist motion. Prototype e clearly shows it is far harder to recline the chair with an occupant's feet off the ground. The underlying ground services as a convenient reaction plane to an occupant's feet. A simple approach to this is difficult to achieve as where the sitter applies the force on the chair back is a factor. There is also the added difficulty of friction between the sitter and the chair. Again experimentation with reducing this friction suggests that the forces applied by the sitter are dependent on this friction coefficient.

Effect of Friction in Sliders.

An important effect is the influence of friction in the sliders. Some friction is necessary in the sliders, because the movement of the chair should not be too easy or disconcerting, both for steadiness and comfort, and also for exercise. A similar consideration applies to bearings. The effect can be regarded as damping.

Allowance of Tilting of Seat Base on Constant PE Calculations.

The forgoing potential energy calculations were based on keeping the seat base horizontal, as in the supporting embodiment chair design. Yet some tilting (forward or backward) of the seat might be desirable. This could be achieved by have two paddles or arms of differing lengths (say) that cause the front and back of the seat to rise and fall by differing amounts depending on the tilt required. The seat would thus effectively 'float' upon spaced arms. The potential energy calculations presented in section 2 could be extended to allow for two paddles and the subsequent tilting of the seat. The geometry and algebra would be harder but it should be feasible to find a suitable curve to ensure neutral stability.

REFERENCES

[1] Human Factors Design Guide. William J. Hughes Technical Centre, Federal Aviation Administration, 1996.

[2] Man-Systems Integration Standards: Volume I NASA-STD-3000 Revision B, NASA, 1995.

[3] Sarah M. Donelson and Claire C. Gordon, Matched Anthropometric Database of U.S. Marine Corps Personnel: Summary Statistics Natick Research, Development and Engineering Centre Technical Report, 1995.

SEQUENCE LISTING

Not applicable.

The invention claimed is:

1. A chair comprising a separate seat and back which are adjustable among a plurality of positions, including a plurality of reclined positions of the back, and a chair frame for supporting the seat and back above a surface, the chair further comprising a subassembly including a seat frame, a drive frame, and a yoke frame, the seat, drive and yoke frames inter-coupled by a plurality of pivot links for floating mobility of the seat frame upon the yoke frame, and wherein the drive frame is connected to the chair back, the yoke frame is connected to the chair frame so as to be stationary relative to the seat frame and the drive frame during relative movement of the seat and drive frames, and the seat frame supports the chair seat; and the plurality of pivot links comprise:

at least a pair of pivot links connecting the seat frame to the yoke frame for rotational movement of the seat frame relative to the yoke frame through a range of motion at least partially defined by the length and position of the at least pair of pivot links;

at least a pair of pivot links connecting the drive frame to the seat frame for rotational movement of the drive frame relative to the seat frame through a range of motion at least partially defined by the length and position of the at least pair of pivot links; and at least one pivot link connecting the yoke frame to the drive frame for rotational movement of the drive frame relative to the yoke frame through a range of motion at least partially defined by the length and position of the at least one pivot link;

wherein, in movement of the chair back into any one of the plurality of reclined positions thereof by an occupant seated in the chair, the drive frame urges movement of the seat frame in directions both horizontally away from, and vertically upwardly relative to, the yoke frame as the chair seat is simultaneously moved into a corresponding one of the plurality of positions thereof.

2. The chair according to claim 1, wherein the chair is operable under a potential energy function in a proportional inter-relationship between back and seat recline movement, for an equally common experience between different occupancy weights.

3. The chair according to claim 1, wherein:

the yoke frame is connected to the chair frame so as to be stationary relative to the seat and drive frames during relative movement of the seat and drive frames;

the plurality of pivot links comprise: at least a pair of pivot links connecting the seat frame to the yoke frame for rotational movement of the seat frame relative to the yoke frame through a range of motion at least partially defined by the length and position of the at least pair of pivot links;

at least a pair of pivot links connecting the drive frame to the seat frame for rotational movement of the drive frame relative to the seat frame through a range of motion at least partially defined by the length and position of the at least pair of pivot links; and at least one pivot link connecting the yoke frame to the drive frame for rotational movement of the drive frame relative to the yoke frame through a range of motion at least partially defined by the length and position of the at least one pivot link; and wherein rotational movement of the seat frame and drive frame are interrelated by the pivot links, such that movement of the drive frame through the range of motion thereof simultaneously effects corresponding movement of the seat frame through the range of motion thereof.

4. The chair according to claim 1, wherein, in adjustment of the position of the chair back by an occupant seated in the chair, the drive frame and seat frame are both simultaneously moveable relative to each other, and to the yoke frame, into any of a plurality of positions, and wherein further movement of the drive frame and seat frame is relative to a virtual pivot point defined proximate an area of the chair seat typically occupied by the hip of a person seated in the chair.

5. The chair according to claim 1, wherein the chair is further characterized in that, when an occupant is seated in the chair with the chair back in any of the plurality of reclined positions thereof, the relative positions of the chair seat and chair back distribute the mass of the seated occupant between the seat frame and the drive frame so that the chair back and chair seat are at least substantially balanced in a neutrally stable position.

6. The chair according to claim 1, wherein the chair is further characterized in that, when an occupant is seated in the chair with the chair back in any of the plurality of reclined positions thereof, the relative positions of the chair seat and chair back distribute the mass of the seated occupant between the seat frame and the drive frame so that, in each of the plurality of reclined positions, the occupant has substantially the same potential energy.

7. The chair according to claim 1, further comprising at least one spring interconnecting the seat frame and the yoke frame, the at least one spring biasing the chair to a fully upright position of the chair back.

* * * * *